US007403185B2

(12) United States Patent
Song et al.

(10) Patent No.: US 7,403,185 B2
(45) Date of Patent: Jul. 22, 2008

(54) LIQUID CRYSTAL DISPLAY DEVICE AND METHOD OF DRIVING THE SAME

(75) Inventors: Hong Sung Song, Kumi-shi (KR); Sung Woong Moon, Kumi-shi (KR)

(73) Assignee: LG Display Co., Ltd., Seoul (KR)

( * ) Notice: Subject to any disclaimer, the term of this patent is extended or adjusted under 35 U.S.C. 154(b) by 641 days.

(21) Appl. No.: 10/878,280

(22) Filed: Jun. 29, 2004

(65) Prior Publication Data

US 2004/0263466 A1 Dec. 30, 2004

(30) Foreign Application Priority Data

Jun. 30, 2003 (KR) ..... 10-2003-0043806

(51) Int. Cl.
*G09G 3/36* (2006.01)

(52) U.S. Cl. ..... 345/100; 345/96

(58) Field of Classification Search ..... 345/100, 345/23, 209, 54, 96
See application file for complete search history.

(56) References Cited

U.S. PATENT DOCUMENTS 5,973,660 A * 10/1999 Hashimoto ..... 345/98

* cited by examiner

*Primary Examiner*—Amr Awad
*Assistant Examiner*—Yong Sim
(74) *Attorney, Agent, or Firm*—McKenna Long & Aldridge LLP

(57) ABSTRACT

A liquid crystal display device includes a plurality of data integrated circuits. Each data integrated circuit includes a charge sharing circuit for electrically connecting all of the data lines together in response to a control signal and a voltage variation limiting circuit for generating the control signal.

10 Claims, 20 Drawing Sheets

FIG.3B
RELATED ART

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 4A
RELATED ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 4B
RELATED ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG. 5A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 5B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

FIG. 6A
RELATED ART

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

FIG. 6B
RELATED ART

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

LIQUID CRYSTAL DISPLAY DEVICE AND METHOD OF DRIVING THE SAME

This application claims the benefit of Korean Patent Application No. P2003-43806 filed in Korea on Jun. 30, 2003, which is hereby incorporated by reference for all purposes as if fully set forth herein.

BACKGROUND OF THE INVENTION

1. Field of the Invention

The present invention relates to liquid crystal display (LCD) devices and methods of driving the same. More particularly, the present invention relates to an LCD device and a method of driving the same capable of effectively applying a charge sharing technique.

2. Discussion of the Related Art

Generally, light transmittance characteristics of liquid crystal cells within liquid crystal display (LCD) devices are controlled by video signals to display desired pictures. Active matrix-type LCDs are capable of displaying moving pictures and include a plurality of liquid crystal cells arranged in a matrix pattern, wherein each liquid crystal cell includes a pixel electrode and a switching device (i.e., a thin film transistor (TFT)).

FIG. 1 illustrates a related art LCD device.

Referring to FIG. 1, the related art LCD device typically includes an LCD panel 14 having m-number of data lines D1 to Dm perpendicularly crossing n-number of gate lines G1 to Gn, wherein liquid crystal cells (Clc) are defined at crossings of the data and gate lines; a plurality of TFTs arranged at the crossings of data and gate lines for driving corresponding liquid crystal cells; a data driving circuit 12 for supplying video signals to the data lines D1 to Dm; a gate driving circuit 13 for supplying scanning pulses to the gate lines G1 to Gn; and a timing controller 11 for controlling the data and gate driving circuits 12 and 13, respectively.

The LCD panel 14 generally includes an upper glass substrate separated from a lower glass substrate by liquid crystal material. The lower glass substrate supports the data lines D1 to Dm and the gate lines G1 to Gn. Arranged at each crossing of the data lines D1 to Dm and the gate lines G1 to Gn, the TFTs transmit video signals from the data lines D1 to Dm to the corresponding liquid crystal cell (Clc) in response to scanning pulses transmitted by the gate lines G1 to Gn. Each TFT includes a gate electrode connected to a corresponding one of the gate lines G1 to Gn, a source electrode connected to a corresponding one of the data lines D1 to Dm, and a drain electrode connected to a corresponding one of the pixel electrodes. Each liquid crystal cell (Clc) includes a storage capacitor Cst for maintaining a voltage charged therein for a predetermined amount of time. Storage capacitors Cst are provided between liquid crystal cells (Clc) connected to the nth gate line and a n−1th pre-stage gate line or between liquid crystal cells (Clc) connected to the nth gate line and a separate common storage line (not shown).

The data driving circuit 12 generally includes a plurality data driving integrated circuits, each of which includes a predetermined number of channels. Each data driving integrated circuit includes a shift register for sampling a clock signal, a register for temporarily storing data, a latch for storing one line of data in response to the clock signal outputted from the shift register and for simultaneously outputting the stored data, a digital-to-analog converter for selecting positive/negative gamma voltages corresponding to a value of the data outputted from the latch, a multiplexer for selecting one of the data lines D1 to Dm to apply analog data (i.e., a video signal that has been converted by the positive/negative gamma voltage), and an output buffer connected between the multiplexer and the selected data line. Such a data driving integrated circuit 12 is controlled by the timing controller 11 to supply video signals to the data lines D1 to Dm.

The gate driving circuit 13 generally includes a shift register for sequentially generating scanning pulses and a level shifter for shifting a voltage of each scanning pulse to a voltage level suitable for driving particular liquid crystal cells (Clc). Such a gate driving circuit 13 is controlled by the timing controller 11 to sequentially supply scanning pulses to the gate lines G1 to Gn in synchrony with the applied video signals.

The timing controller 11 employs vertical (V)/horizontal (H) signals and a clock signal (CLK) to generate gate control signals (GDC) that control the gate driving circuit 13 and data control signals (DDC) that control the data driving circuit 12. The DDC signals include a source start pulse (SSP), a source shift clock (SSC), a source output enable signal (SOE), and a polarity signal (POL). The GDC signals include a gate shift clock (GSC), a gate output enable signal (GOE) and a gate start pulse (GSP).

Many types of inversion driving methods (e.g., frame inversion, line inversion, column inversion method, and dot inversion) are known for use in driving the liquid crystal cells (Clc) of the LCD panel 14.

Referring to FIGS. 2A and 2B, in driving the liquid crystal cells (Clc) of the LCD panel 14 according to the frame inversion driving method, polarities of the video signals applied to each of the liquid crystal cells within the LCD panel 14 are inverted between frames.

Referring to FIGS. 3A and 3B, in driving the liquid crystal cells (Clc) of the LCD panel 14 according to the line inversion driving method, polarities of the video signals applied to adjacent rows of liquid crystal cells within LCD panel 14 are inverted. Additionally, polarities of the video signals applied to each of the liquid crystal cells within the LCD panel 14 are inverted between frames. The line inversion driving method undesirably induces a cross-talk phenomenon between adjacent rows of liquid crystal cells which is manifested by flickering in horizontal stripe patterns between adjacent rows of liquid crystal cells.

Referring to FIGS. 4A and 4B, in driving the liquid crystal cells (Clc) of the LCD panel 14 according to the column inversion driving method, polarities of the video signals applied to adjacent columns of liquid crystal cells within the LCD panel 14 are inverted. Additionally, polarities of the video signals applied to each of the liquid crystal cells within the LCD panel 14 are inverted between frames. Similar to the line inversion method, the column inversion driving method undesirably induces a cross-talk phenomenon between adjacent columns of liquid crystal cells which is manifested by flickering in vertical stripe patterns between adjacent columns of liquid crystal cells.

Referring to FIGS. 5A and 5B, in driving the liquid crystal cells (Clc) of the LCD panel 14 according to a one-dot inversion driving method, the polarity of the polarity signal POL is inverted during each horizontal period such that polarities of the video signals applied to adjacent columns and rows of liquid crystal cells within the LCD panel 14 are inverted. Additionally, polarities of the video signals applied to each of the liquid crystal cells within the LCD panel 14 are inverted between frames. More specifically, during odd-numbered frames as shown in FIG. 5A, liquid crystal cells within odd-numbered columns of odd-numbered rows, in addition to liquid crystal cells within even-numbered columns of even-numbered rows, are supplied with video signals having a positive polarity (+) while liquid crystal cells within even-numbered columns of odd-numbered rows, in addition to liquid crystal cells within odd-numbered columns of even-numbered rows, are supplied with video signals having a negative polarity (−). During even-numbered frames as shown in FIG. 5B, liquid crystal cells within odd-numbered columns of odd-numbered rows, in addition to liquid crystal cells within even-numbered columns of even-numbered rows, are supplied with video signals having a negative polarity (−) while liquid crystal cells within even-numbered columns of odd-numbered rows, in addition to liquid crystal cells within odd-numbered columns of even-numbered rows, are supplied with video signals having a positive polarity (+).

Referring to FIGS. 6A and 6B, in driving the liquid crystal cells (Clc) of the LCD panel 14 according to a two-dot inversion driving method, the polarity of the polarity signal POL is inverted during every two horizontal periods such that polarities of the video signals applied to adjacent columns and pairs of adjacent rows of liquid crystal cells within the LCD panel 14 are inverted. Additionally, polarities of the video signals applied to each of the liquid crystal cells within the LCD panel 14 are inverted between frames.

As described above, the one- and two-dot inversion driving methods minimize the aforementioned cross-talk phenomenon manifested in flicker patterns between the frames (or fields), dramatically improving a picture quality of the LCD panel 14. Because the one- and two-dot inversion driving methods require that the polarities of the video signals be inverted for every column and row (or every other row), however, a significant amount of power is required to drive the liquid crystal cells of the LCD panel 14. In order to reduce this excessive power consumption, data integrated circuits within the data driving circuit 12 include a related art charge sharing circuit 20, as shown in FIG. 7.

Referring to FIG. 7, a related art charge sharing circuit 20 generally includes a plurality of first switching devices SW1 connected between an output buffer 22 and the data lines D1 to Dm and a plurality of second switching devices SW2 connected between adjacent data lines D1 to Dm. Generally, the charge sharing circuit 20 can supply specific voltages to each of the data lines D1 to Dm during a first period and can supply a mean voltage to each of the data lines D1 to Dm during a second period, between consecutive first periods. By supplying the mean voltage between the first periods, the power consumption of the data driving circuit 12 may be beneficially reduced. A more detailed description of the operation for the charge sharing circuit 20 will now be described with reference to FIG. 8.

Referring to FIG. 8, during a low period of the source output enable signal SOE, i.e., a period during which video signals are to be supplied to the data lines D1 to Dm, the charge sharing circuit 20 turns the first switching devices SW1 on. Consequently, positive- and negative-polarity video signals are outputted from the output buffer 22 directly to the data lines D1 to Dm and a desired picture is displayed on the LCD panel 14.

Next, during a high period of the source output enable signal SOE, i.e., a period during which video signals are not supplied to the data lines D1 to Dm, the charge sharing circuit 20 turns the first switching devices SW1 off and turns the second switching devices SW2 on. Consequently, all of the data lines D1 to Dm become electrically connected to each other and, in what may be characterized as "charge sharing," supply a voltage having a mean value between the positive- and negative-polarity voltages supplied to the data lines D1 to Dm during the low period of the source output enable signal SOE to the data lines D1 to Dm.

Accordingly, the related art "charge sharing" coincides with the high period of the source output enable signal SOE. By supplying the mean voltage (i.e., charge sharing) during each high period of the source output enable signal SOE, the differences in voltage values supplied to the data lines D1 to Dm by the first switching devices SW1 during the successive low periods of the source output enable signal SOE may be minimized. By minimizing the difference in voltage values applied to liquid crystal cells, the power consumption of the data driving circuit 12 used to drive the LCD panel 14 according to the one-dot inversion driving method may be reduced. However, the related art charge sharing circuit 20 described above does not effectively reduce the power consumption of the data driving circuit 12 used to drive the LCD panel 14 according to the two-dot inversion driving method for reasons that will be discussed with reference to FIG. 9.

Referring to FIG. 9, the related art charge sharing circuit 20 operates according to the state of the source output enable signal SOE—not according to the state of the polarity signal POL and the polarity of the video signal is inverted every two periods of the source output enable signal SOE, i.e., the high period of the polarity signal POL has a pulse width that overlaps consecutive high periods of the source output enable signal SOE. Therefore, and as identified at reference numeral 24, when a high period of the source output enable signal SOE does not coincide with inversion of a polarity signal POL, all of the data lines D1 to Dm become electrically connected to each other and voltages supplied to the data lines D1 to Dm become non-uniform between successive horizontal periods of the LCD device. As a result of this non-uniformity, power consumption of the data driving circuit undesirably increases.

SUMMARY OF THE INVENTION

Accordingly, the present invention is directed to a liquid crystal display (LCD) device and method of driving the same that substantially obviates one or more of the problems due to limitations and disadvantages of the related art.

Accordingly, an advantage of the present invention provides an LCD device and a method of driving the same capable of adopting a charge sharing technique in inversion driving methods while diminishing power consumption.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, the LCD device may, for example, include a plurality of data integrated circuits, wherein each of the data integrated circuits may, for example, include a charge sharing circuit for electrically connecting data lines to each other in response to a control signal; and a voltage variation limiting circuit for generating the control signal in response to a polarity signal.

In one aspect of the present invention, the data integrated circuit may further include an output buffer for temporarily storing video signals to be outputted to the data lines.

In another aspect of the present invention, the charge sharing circuit may, for example, include a plurality of first switching devices connected between the output buffer and the data lines; and a plurality of second switching devices connected between each of the data lines.

In one aspect of the present invention, the first switching devices may be turned on during a low period of the control signal to transmit video signals from the output buffer to the data lines.

In one aspect of the present invention, the second switching devices may be turned on during a high period of the control signal to electrically connect all of the data lines to each other.

In one aspect of the present invention, the voltage variation limiting circuit may, for example, include a delay circuit for receiving the polarity signal and outputting the received polarity signal as a delayed polarity signal; an XOR gate for performing an XOR operation on the polarity signal and the delayed polarity signal; and an AND gate for performing an AND operation on the output of the XOR gate and a source output enable signal supplied from an external source, thereby producing the control signal.

In one aspect of the present invention, the delay circuit may produce the delayed polarity signal such that the delayed polarity signal overlaps with a rise and fall of a high period of the source output enable signal.

In one aspect of the present invention, the control signal may have the same pulse width as the pulse width of the high period of the source output enable signal.

In one aspect of the present invention, a high period of the control signal may overlap with the high period of the source output enable signal.

In another aspect of the present invention, the delay circuit may, for example, include at least one of flip-flop circuit.

In yet another aspect of the present invention, the control signal may have a period that is equal to a pulse width of a polarity signal.

According to principles of the present invention, a method of driving an LCD device having a plurality of switching devices connected between data lines may, for example, include determining a pulse width of a high period of a polarity signal; and turning the switching devices on when a polarity of the polarity signal is inverted such that all data lines are electrically connected to each other.

In one aspect of the present invention, the method may further include generating a control signal, wherein the control signal turns the switching devices on when a polarity of the polarity signal is inverted.

In one aspect of the present invention, the step of generating the control signal may, for example, include delaying the polarity signal to produce a delayed polarity signal; performing an XOR operation on the polarity signal and the delayed polarity signal; and performing an AND operation on the signal generated by the XOR operation and a source output enable signal supplied from an external source to produce the control signal.

In one aspect of the present invention, the step of delaying the polarity signal may, for example, include delaying the polarity signal such that the polarity signal such that the delayed polarity signal overlaps with a rise and fall of a high period of the source output enable signal In one aspect of the present invention, the control signal may have the same pulse width as the pulse width of the high period of the source output enable signal.

In another aspect of the present invention, a high period of the control signal may overlap with the high period of the source output enable signal.

In yet another aspect of the present invention, the control signal may have a period that is equal to a pulse width of a polarity signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 3A and 3B illustrate a distribution of polarities supplied to liquid crystal cells of an LCD panel during a line inversion driving method;

FIGS. 4A and 4B illustrate a distribution of polarities supplied to liquid crystal cells of an LCD panel during a column inversion driving method;

FIGS. 5A and 5B illustrate a distribution of polarities supplied to liquid crystal cells of an LCD panel during a one-dot inversion driving method;

FIGS. 6A and 6B illustrate a distribution of polarities supplied to liquid crystal cells of an LCD panel during a two-dot inversion driving method;

DETAILED DESCRIPTION OF THE ILLUSTRATED EMBODIMENTS

Reference will now be made in detail to embodiments of the present invention, examples of which are illustrated in the accompanying drawings.

Figure 14:
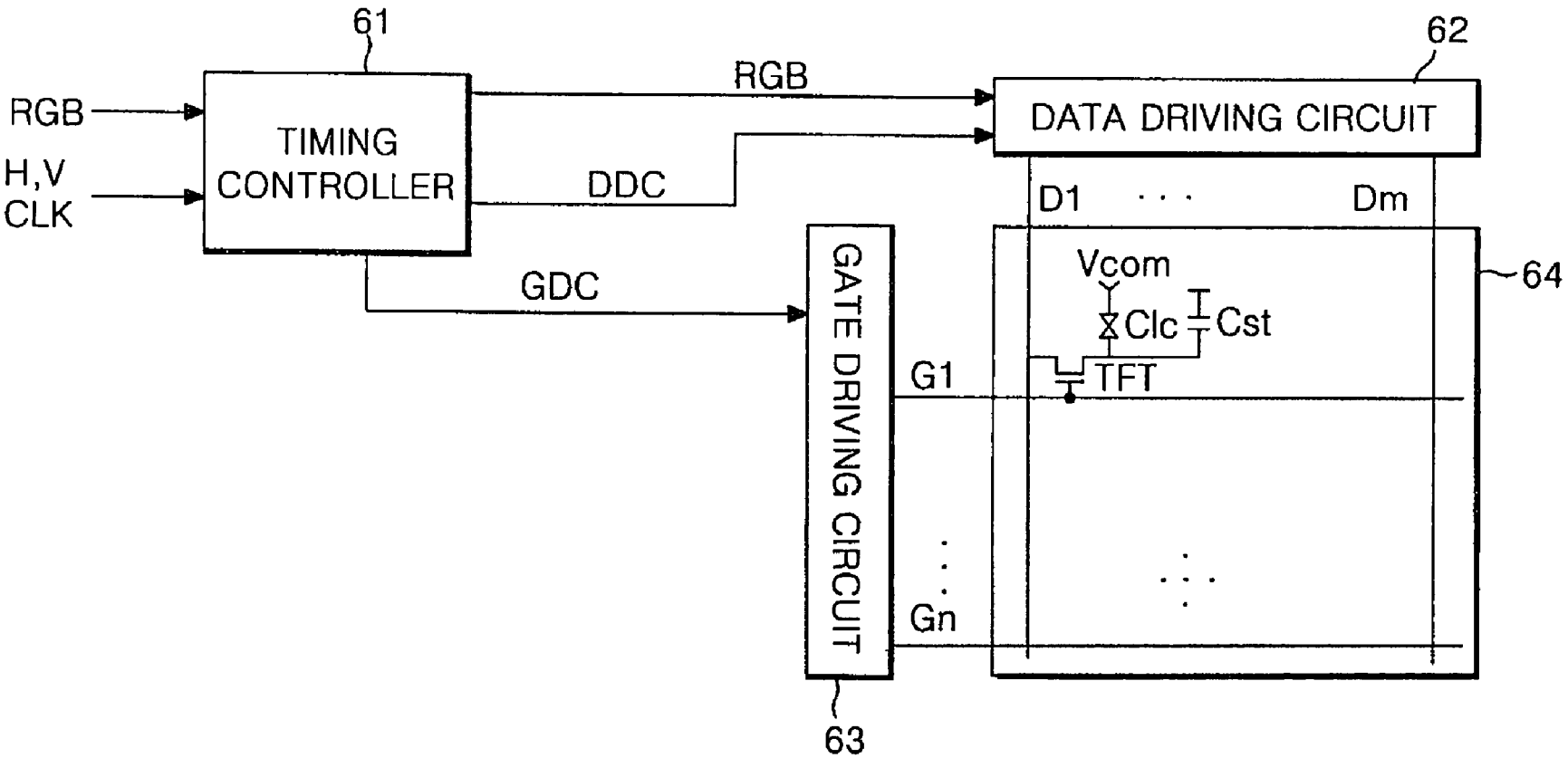
FIG. 14 illustrates an LCD device of the present invention.

FIG. 14 illustrates an LCD device of the present invention.

Referring to FIG. 14, an LCD device of the present invention may, for example, include an LCD panel 64 having m-number of data lines D1 to Dm perpendicularly crossing n-number of gate lines G1 to Gn, wherein liquid crystal cells (Clc) are defined at crossings of the data and gate lines; a plurality of TFTs arranged at crossings of the data and gate lines for driving corresponding liquid crystal cells; a data driving circuit 62 for supplying video signals to the data lines D1 to Dm; a gate driving circuit 63 for supplying scanning pulses to the gate lines G1 to Gn; and a timing controller 61 for controlling the data and gate driving circuits 62 and 63, respectively.

The LCD panel 64 may, for example, include an upper glass substrate separated from a lower glass substrate by liquid crystal material. The lower glass substrate may support the data lines D1 to Dm and the gate lines G1 to Gn. Arranged at each crossing of the data lines D1 to Dm and the gate lines G1 to Gn, each TFT may transmit video signals from the data lines D1 to Dm to a liquid crystal cell (Clc) in response to scanning pulses transmitted by the gate lines G1 to Gn. Each TFT may include a gate electrode connected to a corresponding one of the gate lines G1 to Gn, a source electrode connected to a corresponding one of the data lines D1 to Dm, and a drain electrode connected to a corresponding one of the pixel electrodes. Each liquid crystal cell (Clc) may include a storage capacitor Cst for maintaining a voltage charged therein for a predetermined amount of time. Storage capacitors Cst may be provided between liquid crystal cells (Clc) connected to the nth gate line and a n−1th pre-stage gate line or between liquid crystal cells (Clc) connected to the nth gate line and a separate common storage line (not shown).

The timing controller 61 may, for example, employ vertical (V)/horizontal (H) signals and a clock signal (CLK) to generate gate control signals (GDC) that control the gate driving circuit 63 and data control signals (DDC) that control the data driving circuit 62. The DDC signals may, for example, include a source start pulse (SSP), a source shift clock (SSC), a source output enable signal (SOE), and a polarity signal (POL). The GDC signals may, for example, include a gate shift clock (GSC), a gate output signal enable (GOE) and a gate start pulse (GSP).

The gate driving circuit 63 may, for example, include a shift register for sequentially generating scanning pulses and a level shifter for shifting a voltage of each scanning pulse to a voltage level suitable for driving particular liquid crystal cells (Clc). Such a gate driving circuit 63 may be controlled by the timing controller 61 to sequentially supply scanning pulses to the gate lines G1 to Gn in synchrony with the applied video signals.

Figure 1:
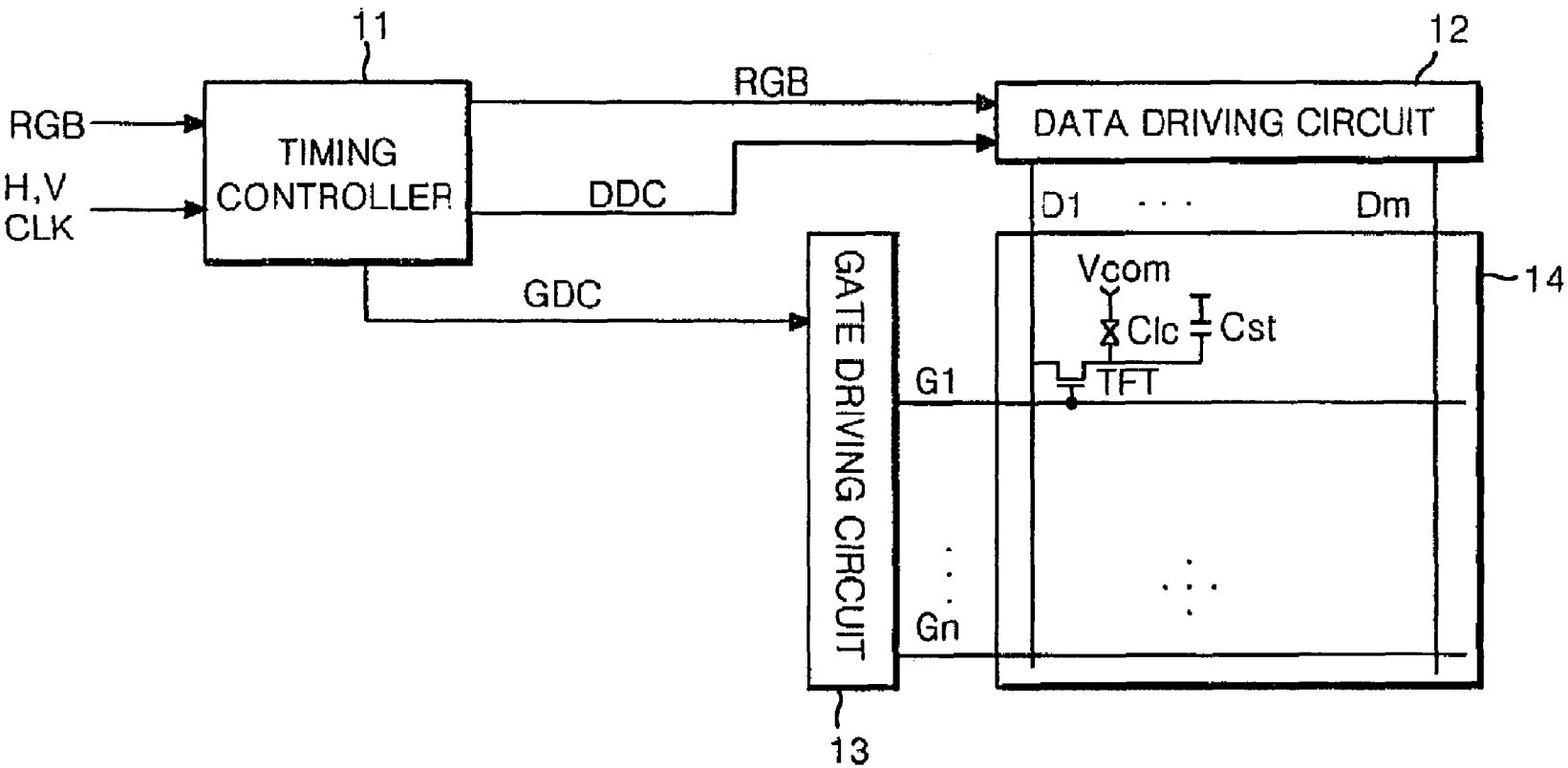
FIG. 1 RELATED ART
FIG. 1 illustrates a related art liquid crystal display (LCD) device.
Figure 2A:
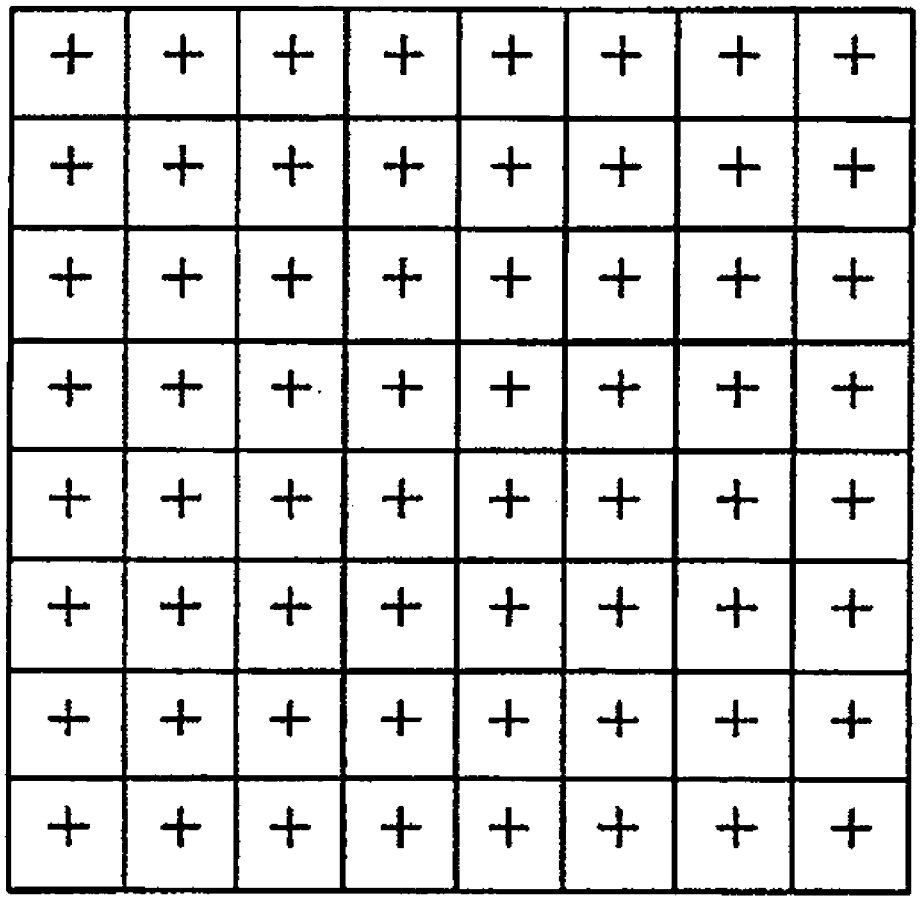
FIG. 2A RELATED ART
FIGS. 2A and 2B illustrate a distribution of polarities supplied to liquid crystal cells of an LCD panel during a frame inversion driving method.
Figure 2B:
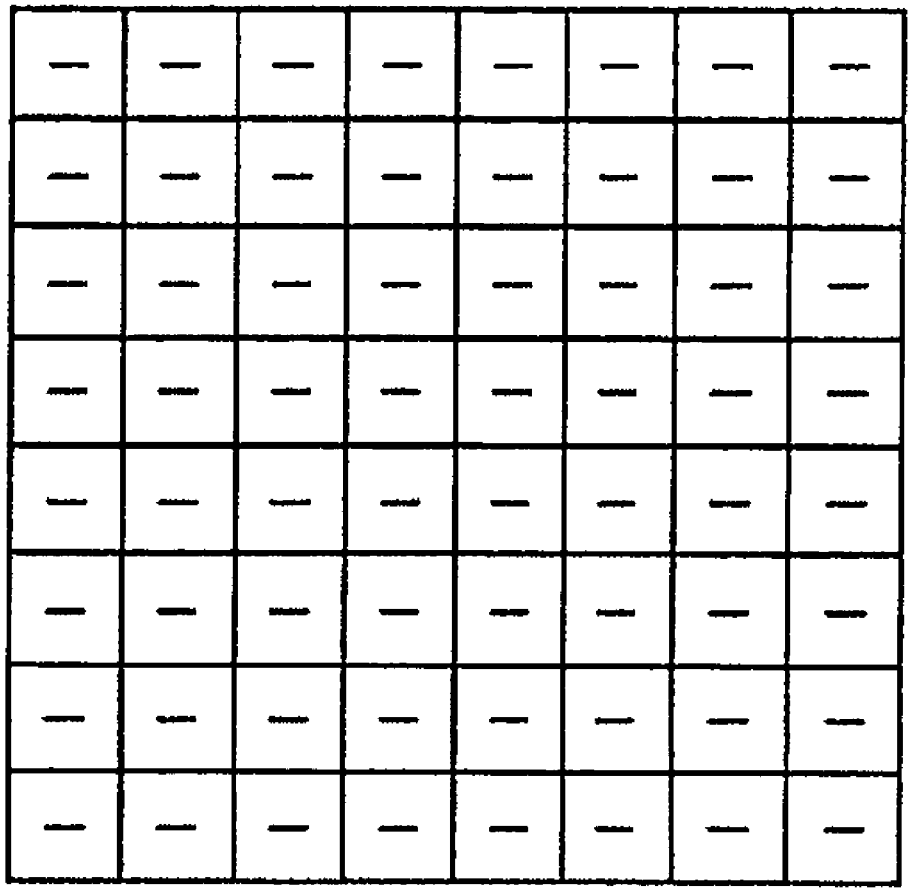
FIG. 2B RELATED ART
Figure 3A:
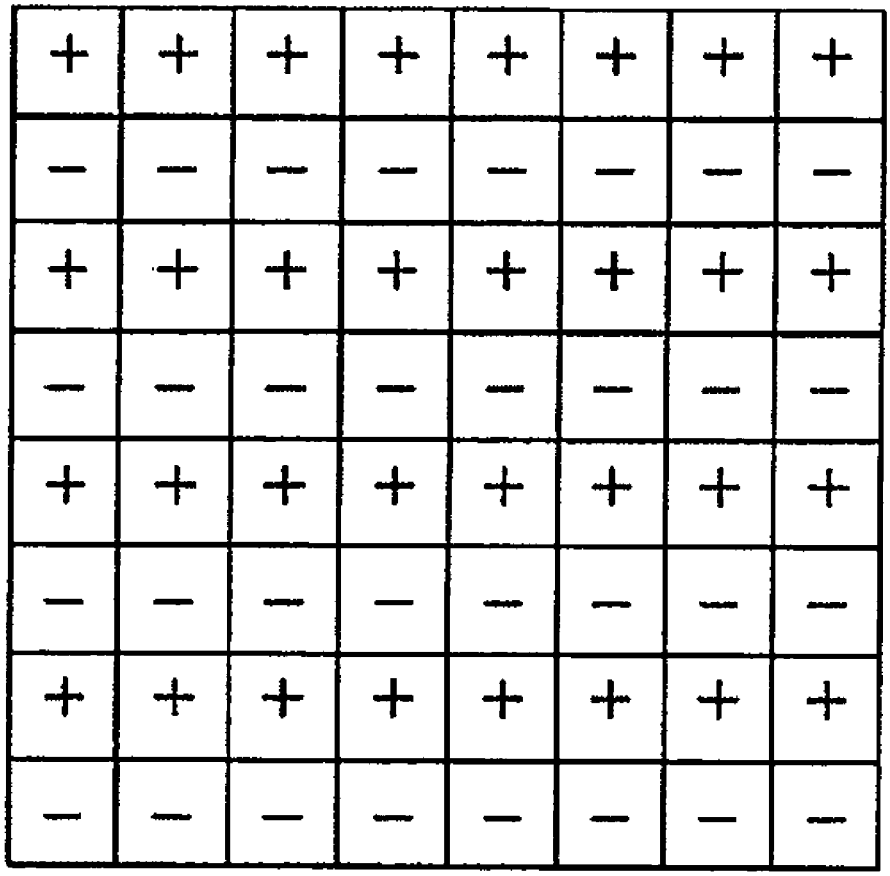
FIG. 3A RELATED ART
Figure 7:
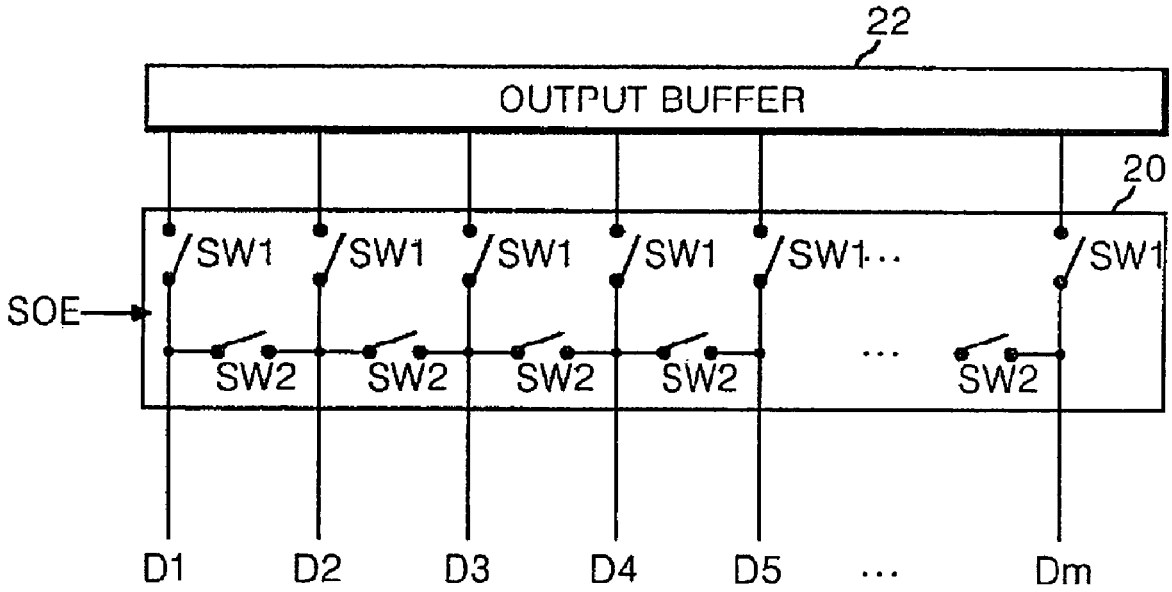
FIG. 7 RELATED ART
FIG. 7 illustrates a related art charge sharing circuit.
Figure 8:
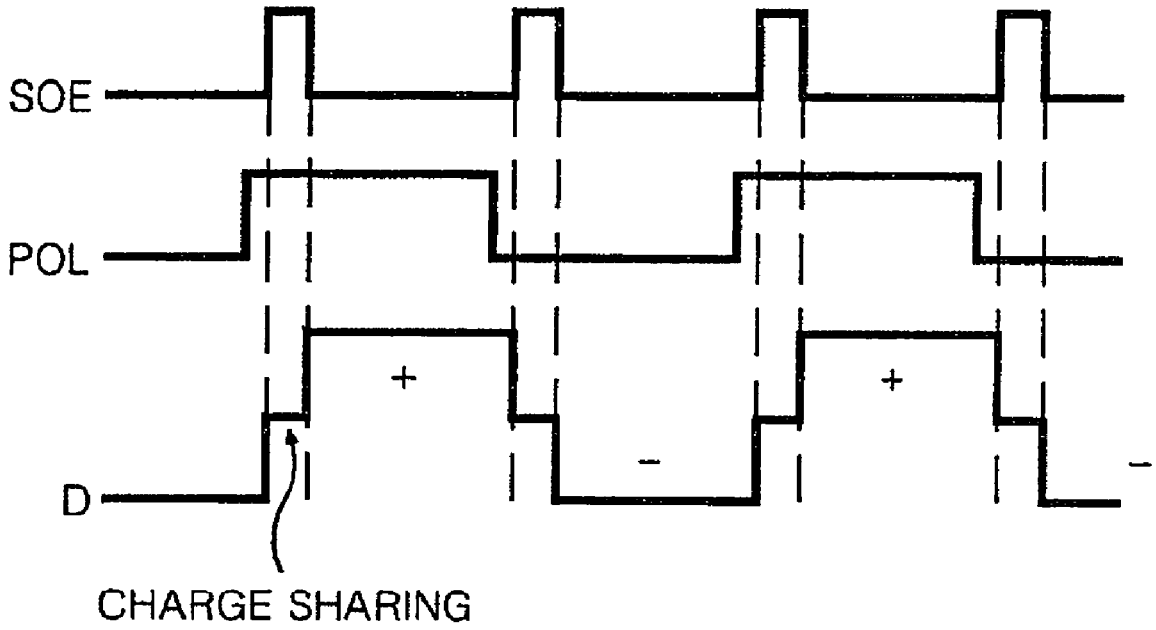
FIG. 8 RELATED ART
FIG. 8 illustrates waveforms generated during operation of the related art charge sharing circuit used in accordance with a one-dot inversion driving method.
Figure 9:
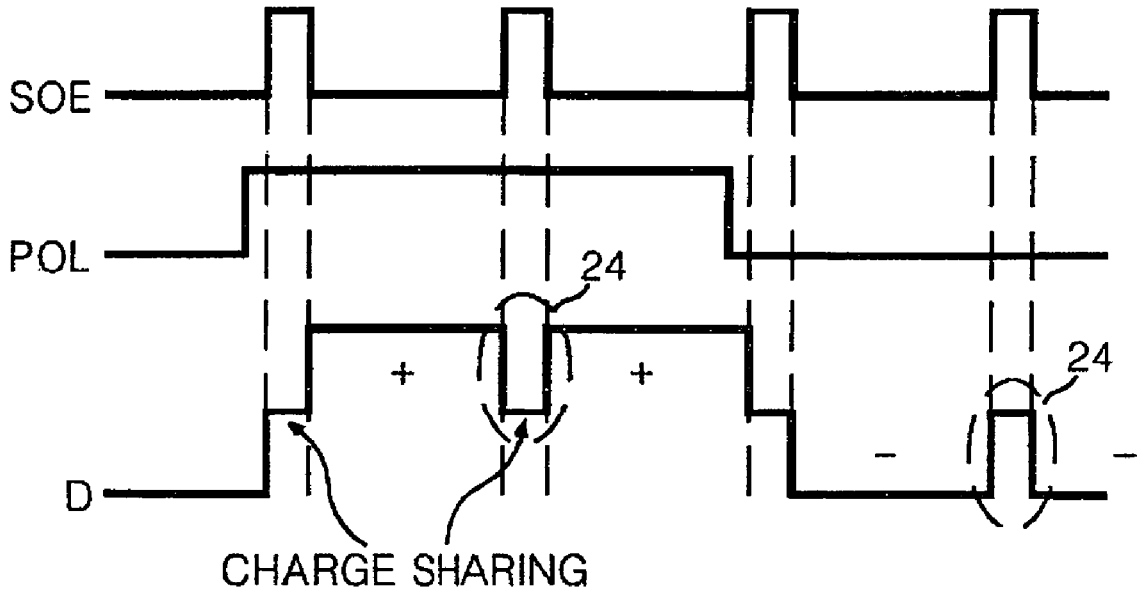
FIG. 9 RELATED ART
FIG. 9 illustrates waveforms generated during operation of the related art charge sharing circuit used in accordance with a two-dot inversion driving method.
Figure 10:
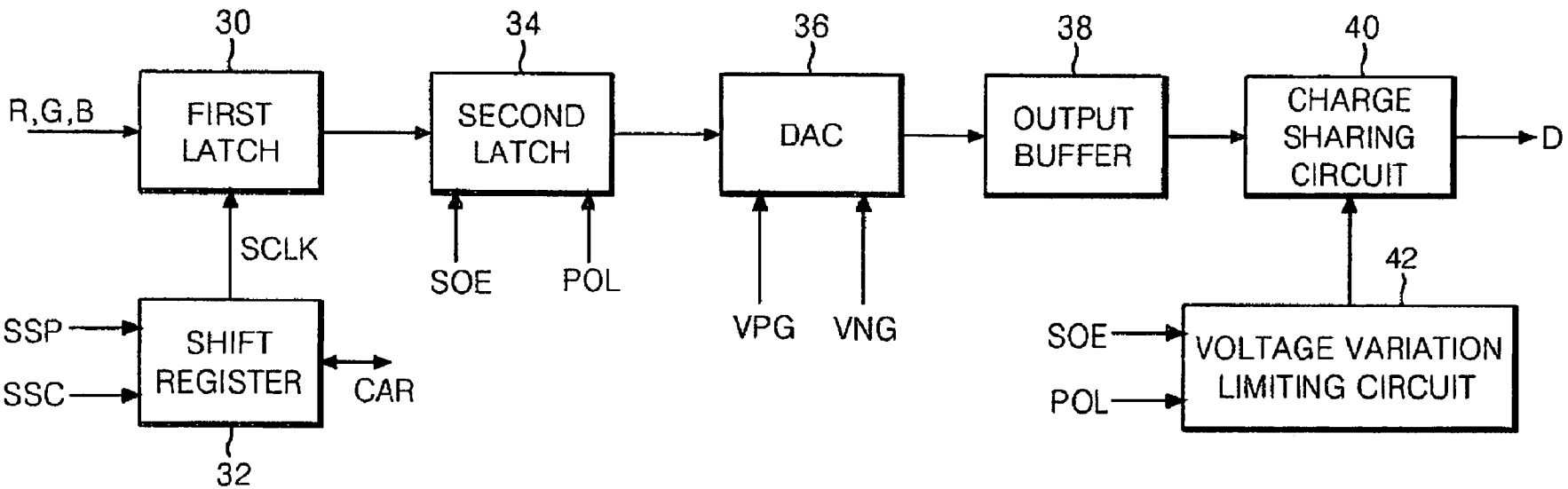
FIG. 10 illustrates a block diagram of a data integrated circuit of an LCD device in accordance with principles of the present invention.

The data driving circuit 62 may, for example, include a plurality data driving integrated circuits, each of which may be controlled by the timing controller 61. FIG. 10 schematically illustrates a representative data integrated circuit within a data driving circuit 62 in accordance with principles of the present invention.

Referring to FIG. 10, each data driving integrated circuit may, for example, include a shift register 32 connected between a timing controller (not shown) and a data line D, a first latch 30, a second latch 34, a digital-to-analog converter (DAC) 36, an output buffer 38, a charge sharing circuit 40 and a voltage variation limiting circuit 42.

The shift register 32 may shift a source start pulse SSP outputted from the timing controller in accordance with a source shift clock signal SSC to generate a sampling signal SCLK. The shift register 32 may also shift the source start pulse SSP to transmit a carry signal CAR to a next-stage shift register.

The first latch 30 may sample externally applied digital video data (RGB), store the sampled digital video data (RGB) in accordance with the sampling signal SCLK, and provide the stored digital video data (RGB) to the second latch 34.

The second latch 34 may latch the digital video data (RGB) from the first latch 30, and, in response to a source output enable signal SOE outputted from the timing controller, output the latched digital video data (RGB) for one horizontal line along with other second latches within other data integrated circuits of the data driving circuit.

The DAC 36 may convert the digital video data outputted from the second latch 34 into an analog video signal having a positive (VPG) or negative (VNG) polarity, wherein the polarity of the analog video signal outputted depends on the polarity signal POL outputted from the timing controller. The polarity signal POL may cause the DAC 36 to output analog video data having polarities corresponding to such inversion driving methods as column inversion, frame inversion, one-, two-, or three-dot inversion driving methods.

The output buffer 38 may temporarily store the analog video data outputted from the DAC 36. Accordingly, the output buffer 38 may delay the output of the analog video data to the charge sharing circuit 40.

As discussed in greater detail below, the charge sharing circuit 40 may supply a voltage to the data lines D having a mean value of the video signal voltages supplied to a previous horizontal line, wherein the voltage is supplied only when a polarity of video signals applied to the LCD panel 64 is inverted. Accordingly, the charge sharing circuit 40 of the present invention may reduce the power consumption of the LCD panel 64.

The voltage variation limiting circuit 42 may prevent the charge sharing circuit 40 from supplying the voltage having the mean value during a period when video signals having a predetermined polarity are to be maintained to reduce power consumption of the LCD device.

Figure 11:
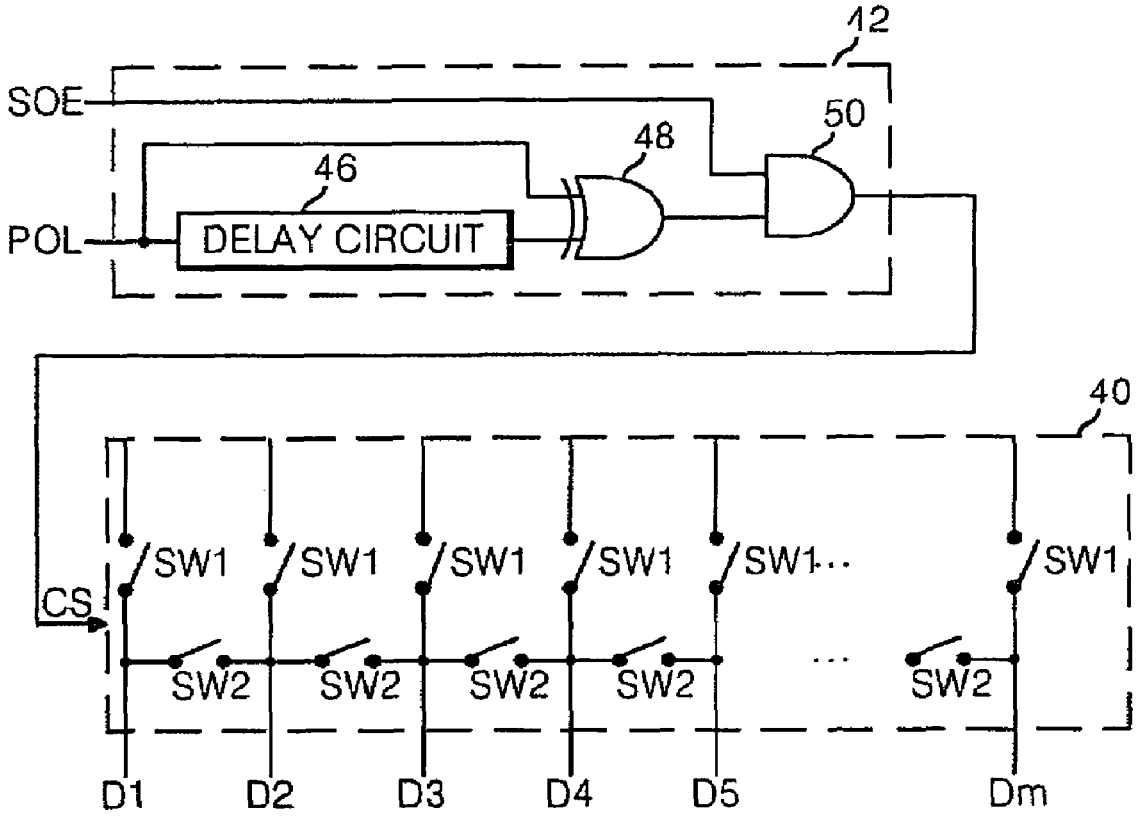
FIG. 11 illustrates a circuit diagram of the charge sharing circuit and the voltage variation circuit shown in FIG. 10.

FIG. 11 illustrates a circuit diagram of the charge sharing circuit and the voltage variation circuit shown in FIG. 10.

Referring to FIG. 11, the charge sharing circuit 40 may, for example, include a plurality of first switching devices SW1 connected between the output buffer 38 and the data lines D1 to Dm and a plurality of second switching devices SW2 connected between adjacent two data lines D1 to Dm. In one aspect of the present invention, the first and the second switching devices SW1 and SW2 may be alternately turned on and off in accordance with a control signal CS outputted by the voltage variation limiting circuit 42.

According to principles of the present invention, the voltage variation limiting circuit 42 may, for example, include a delay circuit 46, an exclusive-OR (XOR) gate 48, and an AND gate 50. In one aspect of the present invention, the delay circuit 46 may delay the outputting of a received polarity signal POL outputted by the timing controller. The XOR gate 48 may perform an XOR operation on the output of the delay circuit 46 (i.e., the delayed polarity signal D-POL) and the polarity signal POL outputted by the timing controller. The AND gate 50 may perform an AND operation on the output of the XOR gate 48 and the source output enable signal SOE outputted by the timing controller.

Figure 12A:
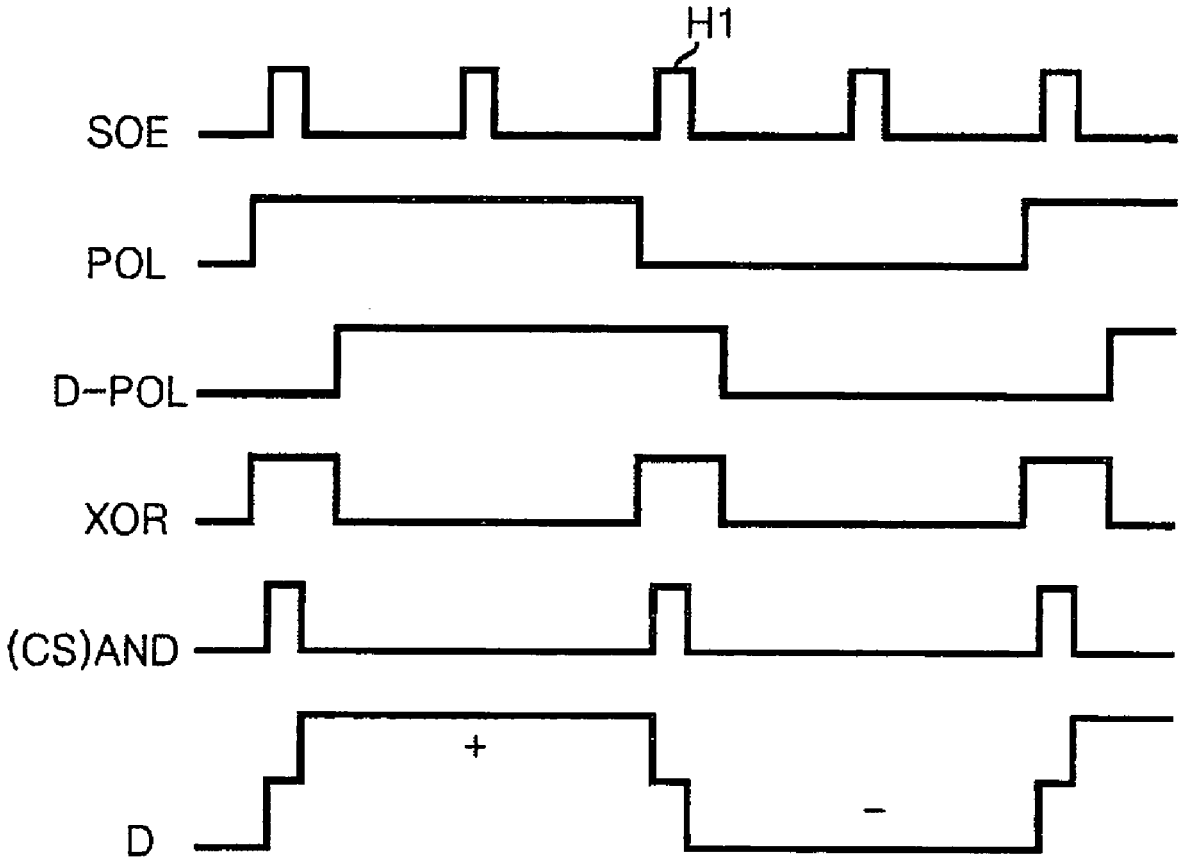
FIGS. 12A and 12B illustrate waveforms generated during operation of the charge sharing circuit and the voltage variation circuit shown in FIG. 10 as applied to LCD devices driven according to two- and three-dot inversion driving methods, respectively.

FIG. 12A illustrates waveforms generated during operation of the charge sharing circuit and the voltage variation circuit shown in FIG. 10 as applied to an LCD device driven according to a two-dot invasion driving method.

Referring to FIG. 12A, the polarity of the polarity signal POL is inverted every other horizontal period to drive the LCD device according to a two-dot inversion driving method. Accordingly, the polarity signal POL is outputted from the timing controller to the delay circuit 46. The delay circuit 46 then delays the output of the received polarity signal POL to the XOR gate 48 by a predetermined amount of time. As shown in FIG. 12A, the polarity signal POL outputted by the timing controller does not overlap with a high pulse H1 of the source output enable signal SOE. However, the delay circuit 46 may output the received polarity signal POL as a delayed polarity signal D-POL to overlap with the high pulse H1 of the source output enable signal SOE. In one aspect of the present invention, the delayed polarity signal D-POL may be outputted by the delay circuit 46 so as to overlap with the rise and fall of the high pulse H1 of the source output enable signal SOE.

The XOR gate 48 may perform an XOR operation on the delayed polarity signal D-POL outputted by the delay circuit 46 and the polarity signal POL outputted by the timing controller. As shown in FIG. 12A, a high period of the pulse outputted by the XOR gate 46 overlaps with the high pulse H1 of the source output enable signal SOE.

The AND gate 50 performs an AND operation on the output of the XOR gate 48 and the source output enable signal SOE outputted by the timing controller to generate a control signal (CS). Accordingly, and in one aspect of the present invention, the control signal (CS) has a period equal to a pulse width of the high period of the polarity signal POL outputted by the timing controller (i.e., the control signal (CS) has a period corresponding to two horizontal periods of the LCD device). In another aspect of the present invention, the control signal (CS) has a pulse width equal to the high pulse H1 of the source output enable signal SOE. In yet another aspect of the present invention, the high pulse of the control signal (CS) overlaps the high pulse H1 of the source output enable signal SOE.

According to principles of the present invention, the charge sharing circuit 40 turns the first switching devices SW1 on during a low period of the control signal (CS). Consequently, the analog video signals are outputted by the output buffer 38 directly to the data lines D1 to Dm and a desired picture is displayed by the LCD device. Because the control signal CS has a period of two horizontal periods of the LCD device, the first switching devices SW1 are maintained in their turn-on states until analog video signals corresponding to the next two horizontal rows of liquid crystal cells are supplied. Accordingly, unnecessary voltage variations, i.e., charge sharing, do not occur when analog video signals having a same polarity are applied to consecutive rows of liquid crystal cells.

Next, during a high period of the control signal (CS), the charge sharing circuit 40 turns the first switching devices SW1 off and turns the second switching devices SW2 on. Consequently, all of the data lines D1 to Dm become electrically connected to each other and, in what may be characterized as "charge sharing," supply a voltage having a mean value between the positive- and negative-polarity voltages supplied to the data lines D1 to Dm during the low period of the control signal (CS) to the data lines D1 to Dm.

Figure 12B:
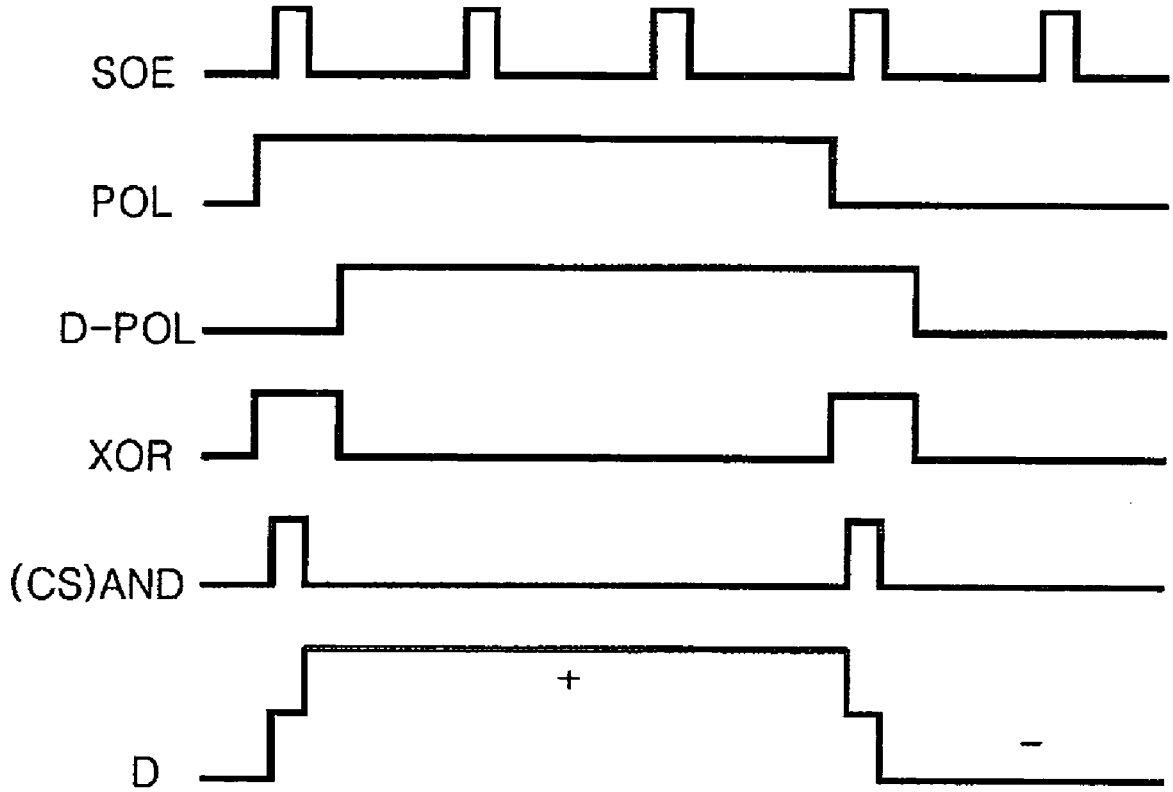

Accordingly, the charge sharing of the present invention coincides with the high period of the control signal (CS). As such, the charge sharing of the present invention occurs only upon inversion of video signal polarities supplied to the LCD device—not when the video signal polarities supplied to the LCD device are maintained. Accordingly, the charge sharing circuit 40 of the present invention consumes less power than the related art charge sharing circuit 20. Moreover, the principles of the present invention may be extended to substantially any suitable dot or column inversion driving method in which the polarity of voltages supplied to adjacent columns of liquid crystal cells are inverted. For example, and with reference to FIG. 12B, a control signal CS having a period corresponding to three horizontal periods of the LCD device may be generated where the LCD device is to be driven according to a three-dot inversion driving method. Accordingly, the principles of the present invention prevent the charge sharing from occurring while polarities of supplied video signals are maintained on the LCD device.

Figure 13:
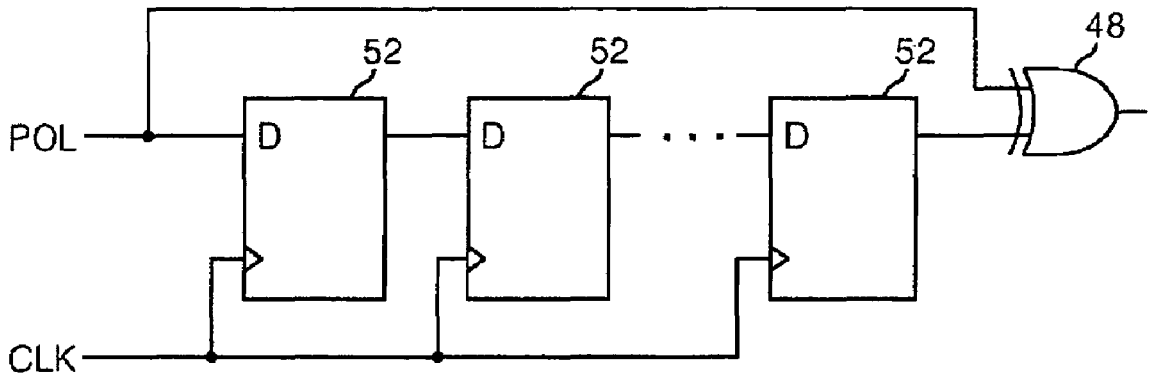
FIG. 13 illustrates a circuit diagram of the delay circuit shown in FIG. 11.

FIG. 13 illustrates a circuit diagram of the delay circuit shown in FIG. 11.

Referring to FIG. 13, the delay circuit 46 may be provided as substantially any type of delay circuit. In one aspect of the present invention, the delay circuit may, for example, use one or more flip-flop circuits 52 to delay the polarity signal POL outputted by the timing controller.

As described above, the charge sharing circuit of the present invention generates a control signal having a period corresponding to a pulse width of a polarity signal (e.g., a high pulse width or a low pulse width) to prevent the charge sharing from occurring while polarities of supplied video signals are maintained on the LCD device, and thereby to diminish power consumption of the data driving circuit.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a data driving circuit having a plurality of data integrated circuits, wherein each of the data integrated circuits includes:

a charge sharing circuit that electrically connects all of a plurality of data lines of the liquid crystal display device to each other in response to a control signal; and a voltage variation limiting circuit that generates the control signal in response to a received polarity signal, wherein the voltage variation limiting circuit includes:

a delay circuit that delays the received polarity signal and outputs the received polarity signal as a delayed polarity signal;

an XOR gate for performing an XOR operation on the received polarity signal and the delayed polarity signal; and an AND gate for performing an AND operation on the output of the XOR gate and a source output enable signal outputted from an external source to produce the control signal.

2. The liquid crystal display device according to claim 1, wherein the delayed polarity signal overlaps with a rise and fall of a high period of the source output enable signal.

3. The liquid crystal display device according to claim 1, wherein the control signal has the same pulse width as the pulse width of the high period of the source output enable signal.

4. The liquid crystal display device according to claim 3, wherein a high period of the control signal overlaps the high period of the source output enable signal.

5. The liquid crystal display device according to claim 1, wherein the delay circuit includes at least one of flip-flop circuit.

6. A method of driving a liquid crystal display device having a plurality of switching devices connected between a plurality of data lines to connect the data lines together, the method comprising:

determining a pulse width of a high period of a received polarity signal outputted in accordance with a predetermined inversion driving method;

generating a control signal for turning the plurality of switching devices on only when the polarity of the polarity signal is inverted; and turning the plurality of switching devices in response to the control signal to electrically connect all of the data lines together, wherein the step of generating the control signal includes:

delaying the received polarity signal to produce a delayed polarity signal;

performing an XOR operation on the received polarity signal and the delayed polarity signal; and performing an AND operation on the result of the XOR operation and a source output enable signal outputted from an external source.

7. The method according to claim 6, wherein the step of delaying the received polarity signal includes delaying the received polarity signal such that the delayed polarity signal overlaps with a rise and fall of a high period of the source output enable signal.

8. The method according to claim 6, wherein the control signal has the same pulse width as the pulse width of the high period of the source output enable signal.

9. The method according to claim 8, wherein a high period of the control signal overlaps the high period of the source output enable signal.

10. The method according to claim 8, wherein the control signal has a period that is equal to a pulse width of the received polarity signal.

* * * * *